US005618391A

United States Patent [19]

May et al.

[11] Patent Number: 5,618,391

[45] Date of Patent: Apr. 8, 1997

[54] DEVICE FOR ELECTROLYTICALLY COATING ONE SIDE OF METAL STRIPS

[76] Inventors: Hans J. May, Ulmenweg 17, D-58638 Iserlohn; Roland Schnettler, Schwerter Strasse 138, D-58099 Hagen, both of Germany

[21] Appl. No.: 433,420

[22] PCT Filed: Oct. 22, 1993

[86] PCT No.: PCT/DE93/01015

§ 371 Date: May 9, 1995

§ 102(e) Date: May 9, 1995

[87] PCT Pub. No.: WO94/10360

PCT Pub. Date: May 11, 1994

[30] Foreign Application Priority Data

Oct. 31, 1992 [DE] Germany ..... 42 36 927.4

[51] Int. Cl.[6] ..... C25D 17/00; C25D 5/02

[52] U.S. Cl. ..... 204/212; 204/206; 205/130; 205/137; 205/138; 205/152

[58] Field of Search ..... 204/206, 212; 205/130, 137, 138, 152

[56] References Cited

U.S. PATENT DOCUMENTS

| | | | |
|---|---|---|---|
| 2,044,415 | 6/1936 | Yates | 205/137 |
| 3,483,098 | 12/1969 | Kramer | 204/206 |
| 3,900,383 | 8/1975 | Austin et al. | 204/211 |
| 4,132,617 | 1/1979 | Noz | 204/206 |
| 4,582,583 | 4/1986 | Laverty | 204/206 |
| 5,069,762 | 12/1991 | Modrowski et al. | 205/137 |

FOREIGN PATENT DOCUMENTS

| | | |
|---|---|---|
| 125707 | 3/1984 | European Pat. Off. . |
| 2078951 | 11/1971 | France . |
| 59-89790 | 5/1984 | Japan . |

OTHER PUBLICATIONS

Derwent and JAPIO abstracts and Fig. 4 of JP05279892 (Kurusu Ryozaburo) Oct. 26, 1993.

*Primary Examiner*—Kathryn Gorgos
*Assistant Examiner*—Alexander Noguerda
*Attorney, Agent, or Firm*—Collard & Roe, P.C.

[57] ABSTRACT

In a device for electrolytically coating one side of metal strips (2), the metal strips to be coated are guided around a rotary cathodic current roller (1), which they contact, and a partially cylindrical, insoluble anode (3) is arranged approximately concentrically around the current roller, at a distance thereof. The interval (4) between the section (21) of the strip guided on the current roller (1) and the anode (3) is delimited in the area of the strip edges (22) by seals (5) which can be oriented in a direction parallel to the axis of the roller. The electrolyte flows through the interval (4).

3 Claims, 1 Drawing Sheet

DEVICE FOR ELECTROLYTICALLY COATING ONE SIDE OF METAL STRIPS

Figure 1:
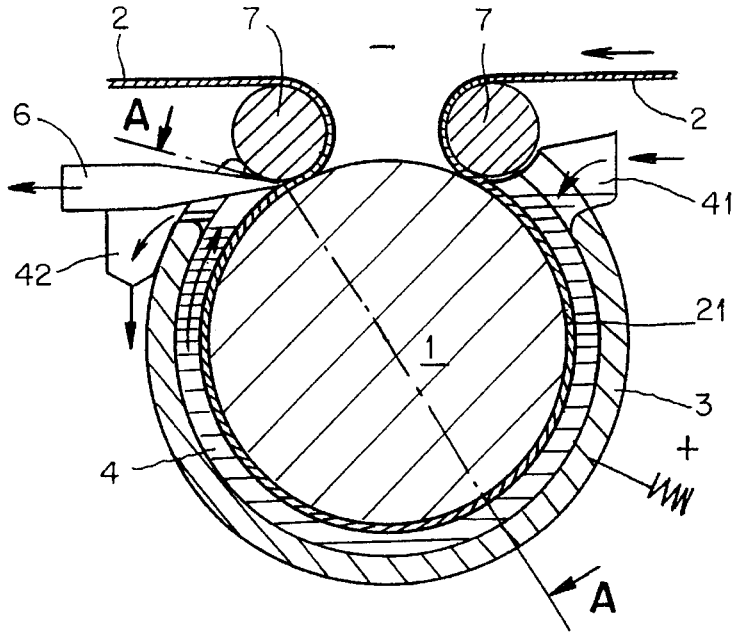

This is a 371 of PCT/93/0105 filed Oct. 22, 1993.

The invention relates to a device for electrolytically coating one side of metal strips, in which the metal strips to be coated are contactingly guided around a rotating cathodic current roller, and a partially cylindrical, insoluble anode is arranged approximately concentrically around the current roller with a spacing from the latter, whereby the electrolyte flows through the spacing.

In such a device, which is known from U.S. Pat. No. 3,900,383, the unit comprising the current roller, the metal strip to be coated, the latter looping around said roller by about 180°, and the partly cylindrical anode arranged with a spacing from said roller is completely immersed in an electrolyte bath in a tub. The continous contacting of the metal strip to be coated, particularly a very thin strip, has the advantage that voltage drops are avoided because the electrical field develops exclusively between the concentrically arranged anode and the cathodic current roller or metal strip resting against the latter. However, the drawback with said known device is the risk of coating the current roller in the lateral zones not covered by the metal strip to be coated. In addition, there is the risk of electrolyte entering between the current roller and the metal strip, leading to undesirable coatings. Particularly in connection with very thin strips, for example metal foils, it is not possible to design the width of the current roller smaller than the width of the strip, because the support of the latter would be missing in that case. Also, with such a design, the projecting lateral strip would again be used for conducting current. This would result in voltage drops and thus heating of the strip in the edge zones.

If the strip width is smaller than the roller width, the protruding zone of the roller is galvanized. Since strips and foils of varying width are coated in such installations, the rollers would have to be exchanged according to the width of the strip.

Also, a device of the type specified above is known from EP-OS 0 125 707, in which the electrolyte is exclusively guided within the spacing (gap) between the partly cylindrical anode and the cylindrical cathodic current roller, while maintaining a turbulent forced flow.

In this case too, there is the risk of undesirable coating of the current roller, which obviously comes into contact with the electrolyte. The electrolyte is admitted via an inlet tube extending across the total width of the current roller. With such an arrangement, the electrolyte can obviously exit from the gap between the anode and the current roller also on the face side and pass into a container arranged underneath. Therefore, the risk that electrolyte may enter between the metal strip to be coated and the current roller exists in this case as well.

The problem of the invention consists in proposing a device of the type specified above, in which it is assured that the electrolyte does not come into contact with the surface of the current roller.

The problem of the invention is solved with a device of the type specified above, which device is characterized in that provision is made for seals between the section of the strip guided on the current roller and the anode, such seals being installed in each case within the zone of the edge of the strip in the axially parallel direction. In this way, the space of the electrolyte is limited to the width of the strip, so that wetting of the current roller with electrolyte is avoided. In adaptation to the given width of the metal strip to be coated, the sealing can be installed on both sides of the strip, with a nearly uncoated zone of the edge of the strip remaining, which, however, is separated in the manufacture of such strips in any case.

The invention also comprises the proposal of lubricating the sealing side with blocking water against the section of the strip guided on the current roller, with the intention to prevent any electrolyte that may pass through the sealing from coming into contact with the current roller.

According to a further proposal of the invention, electrolyte suction devices can be arranged within the zone of the ends of the seals in connection with one or a plurality of squeezer or reversing rollers, by which devices it is prevented that any electrolyte that may have been dragged along is wetting in the respective zones the current roller behind the seals.

Figure 2:
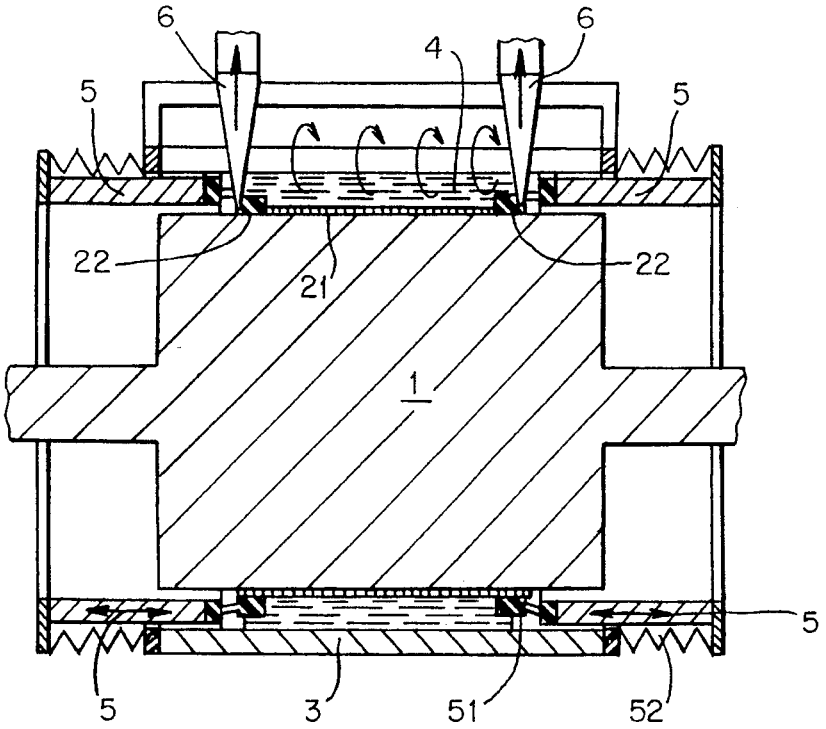

A device according to the invention is explained in greater detail in the following on an exemplified embodiment shown in general in the drawing, in which:

FIG. 1 shows a section through a device for electrolytically coating metal strips on one side; and FIG. 2 shows a section according to line A—A in FIG. 1.

A metal strip 2 to be coated on the outside is guided in the direction of the arrow around the driven cathodic current roller 1, contacting the latter with a looping angle of greater than 180°. In this connection, the strip coming from the right according to FIG. 1, is guided via a reversing roller 7 with as little spacing as possible from the current roller, and passed on the opposite side via the reversing roller 7 after it has been coated. A partially cylindrical anode 3 is arranged around the current roller with the strip 2, whose section resting against said roller is denoted by reference numeral 21. The electrolyte is passed through the spacing 4, said electrolyte entering on the right side of FIG. 1 at reference numeral 41 and being withdrawn on the other side via the outlet 42.

Laterally, the spacing 4 (gap) between the strip section 21 and the anode 3 is limited by the seals indicated by the reference numeral 5, which seals can be installed concentrically.

Said displaceable seals 5 each engage with the adjustable sealing section 51 the strip edge zones 22 of the strip section 21 to be coated. A seal 52 arranged on the outside, for example a sealing bellows, seals against the face side of the anode 3.

Preferably, a suction device 6 extending across the total width of the current roller or only within the range of the seal ends, said device being adjustable with the seals to the width of the strip, can be arranged above the electrolyte outlet upstream of the reversing roller 7 or a suitable squeezing roller, for removing any electrolyte that may have been dragged along.

Within the zone of the seals 5, particularly, however, within the zone of the sealing sections 22 resting against the strip section 21 to be coated, provision can be made for so-called blocking water lubrications from the outside, by which any electrolyte that may exit is prevented from effectively wetting the adjacent zone of the current roller. In this way, any electrolyte that may exit is rinsed off or highly diluted and consequently no longer effecting the coating.

We claim:

1. Device for electrolytically coating a metal strip on one side thereof comprising a rotating cathodic current roller around which the metal strip section to be coated is contactingly guided;

a partially cylindrical, insoluble anode arranged approximately concentrically around the current roller with a spacing from the current roller;

an electrolyte for flowing through the spacing and having a coating material;

means for preventing a deposition of the coating material on the current roller in positions where no strip contact is achieved; and said means for preventing said deposition of coating-material comprising seals arranged between the strip section guided on the current roller and the anode, in each case within a zone of edges of the strip; and said seals having means for being adjustable in an axially parallel direction to a width of the metal strip to be coated.

2. Device according to claim 1, wherein the side of the seal against the strip section guided on the current roller is lubricated with blocking water.

3. Device according to claim 1, wherein electrolyte suction devices are arranged within the zone of the ends of the seals in connection with one or a plurality of squeeze-off rollers.

* * * * *